US006991066B2

(12) United States Patent
Persky

(10) Patent No.: US 6,991,066 B2
(45) Date of Patent: Jan. 31, 2006

(54) CUSTOMIZED SELF-CHECKOUT SYSTEM

(75) Inventor: Michael Persky, New Canaan, CT (US)

(73) Assignee: International Business Machines Corporation, Armonk, NY (US)

( * ) Notice: Subject to any disclaimer, the term of this patent is extended or adjusted under 35 U.S.C. 154(b) by 185 days.

(21) Appl. No.: 10/357,077

(22) Filed: Feb. 3, 2003

(65) Prior Publication Data

US 2003/0217892 A1 Nov. 27, 2003

Related U.S. Application Data

(60) Provisional application No. 60/353,428, filed on Feb. 1, 2002.

(51) Int. Cl.
*A47F 9/04* (2006.01)
*G07G 1/12* (2006.01)

(52) U.S. Cl. ..... 186/59; 235/4

(58) Field of Classification Search ..... 186/59, 186/35, 36, 52; 235/2, 4, 383; 705/16, 18, 705/50, 51, 52, 64, 75

See application file for complete search history.

(56) References Cited

U.S. PATENT DOCUMENTS

| | | | | |
|---|---|---|---|---|
| 6,055,573 | A * | 4/2000 | Gardenswartz et al. | 709/224 |
| 6,296,185 | B1 * | 10/2001 | Dejaeger | 235/383 |
| 2002/0079367 | A1 * | 6/2002 | Montani | 235/383 |
| 2002/0082925 | A1 * | 6/2002 | Herwit | 705/16 |

FOREIGN PATENT DOCUMENTS

EP 0.991.003 A2 * 5/2000

* cited by examiner

*Primary Examiner*—Donald P. Walsh
*Assistant Examiner*—Mark J. Beauchaine
(74) *Attorney, Agent, or Firm*—Mintz, Levin, Cohn, Ferris, Glovsky and Popeo, P.C.

(57) ABSTRACT

The present invention is directed to systems and methods relating to a customizable self-checkout system including a self-checkout device for processing items for purchase by a customer, a processor for controlling the operations of the self-checkout device, and a memory for receiving customer profile data. The processor adapts the operation of the self-checkout system in accordance with the customer profile data.

41 Claims, 6 Drawing Sheets

CUSTOMIZED SELF-CHECKOUT SYSTEM

CLAIM TO PRIORITY

The present invention claims benefit under 35 U.S.C. § 119(e), of U.S. provisional application No. 60/353,428, filed Feb. 1, 2002, the entire disclosure of which is herein incorporated by reference.

FIELD OF THE INVENTION

The present invention is directed to the field of checkout methods and systems for retail establishments. More particularly, the present invention may also relate to a system and method for customizing the checkout for purchasing goods at retail establishments. Such methods and systems are particularly applicable to self-checkout systems.

BACKGROUND OF THE INVENTION

The retail merchandiser and supermarket industries have placed an impetus on reducing labor costs. Additionally, they have expended time and energy in a variety of different ways to reduce or eliminate the amount of time required to process items to be purchased by a customer. To that end, there have been a number of self-checkout system concepts developed which attempt to substantially eliminate the need for a checkout clerk.

It has been found, however, that some customers, through repetitive use of a self-checkout system, become expert users and do not require the same instructional messaging as novice or problematic users. Audio and video instructional presentations are used at displays of self-checkout systems to help make the system more intuitive to first instance users. Thus, for experienced users, the instructional presentations are no longer required since they unnecessarily lengthen transaction time.

Another drawback of non-customizable self-checkout systems is that a universal system speed impedes efficient customer throughput. Customers generally want to proceed with and finish the self-checkout process as expeditiously as possible. Self-checkout systems with single speed functionality slow down user transaction time due to unnecessary system prompting and extensive item security checks.

Additionally, the one-size fits all approach to customer interface components has not enabled prior art systems to present unique marketing information tailored to individual consumers. Therefore, self-checkout customers are missing out on individualized promotional discounts they could be provided, for example, through customized shopping habit analysis, and retailers may be missing out on potential ad revenue for such a feature.

U.S. Pat. Nos. 4,676,343, 4,792,018, 5,340,970, and 6,497,362, commonly-assigned with the present application (and incorporated herein by reference), present systems for operator-unattended checkout with particular concern for detection of customer fraud and deterrence of the same. These systems process orders at single speeds without customer-specific customization based on a universal security standard. Additionally all customers are presented with a universal informational and instructive display configuration that does not take into account that some customers may be more experienced with self-checkout than others.

Prior art processing of items at self-checkout systems has been based on an assumption that the consuming public requires universal security, instructional display and speed configuration for conducting item transactions. What is needed is a self-checkout system that can process learned customer utilization data, display unique promotional discounts and enable selective system interface/processing parameters to meet unique customer profiles. Moreover, what is also needed is a system which can also automatically configure "security zone" specifications to optimize customer throughput.

SUMMARY OF THE INVENTION

In one embodiment of the present invention, customization of the shopping transaction is produced by implementing, for example, variable transaction speeds, customized security and customer user interface display configurations for experienced customers and those with particular customer profiles. The invention may also enable customization of the self-checkout shopping transaction by implementing customized customer interface display, security and transaction speed configurations for inexperienced customers and those with less favorable customer profiles as well.

In another embodiment of the present invention, the self-checkout systems/methods according to the present invention response to and adjust the shopping experience (which may be determined by comparison data). The data collected and evaluated may include, for example: speed at which a customer uses the self-checkout system, errors generated by a particular customer, number of products (alone and as part of total) purchased that are outside the normal process (large pass around items, flowers, etc.), the number of times the system is used by the customer; the size and shape of the customer order, tender and coupon types utilized, generation of system messages including (for example) rear arch or tower blocked and age restricted items; past security violations, and number of produce or non-bar coded items purchased in the past and identification of such items. Of course, data associated with the particular user's historical use of a self-checkout system may be used.

In another embodiment of the present invention, the self-checkout system may react to any of the above data and/or additional data supplied from other sources, including the customer himself, to change self-checkout device shopping experience to the benefit of the customer and/or retailer.

In still another embodiment of the present invention, a method for customizing a self-checkout system may include creating a unique customer history profile for each customer which may include the customization data collected from past shopping transactions. The shopping profile information may also include other data including items purchased, use of coupons, payment methods, as well as any other information that can be associated with this customer from the host point-of-sale (POS), electronic marketing (EM) systems and any other source of information.

Moreover, another embodiment of the present invention may also automatically offer advertising and promotional discounts based on past transactions of a customer. Specifically, the retailer may include retailer/customer specific algorithms which allow for custom tailored advertisements to be displayed at a display of the self-checkout system based on a criteria set out by the retailer for certain customer profiles.

Additionally, the present invention may also present new processes which allow for heightened scrutiny of customers with high-risk security profiles. Information and data from problematic customers who try to fraudulently use the system is stored in the customer profile. Accordingly, the self-checkout system may increase the security tolerances for items, as well as not allow certain transactions (or the shopping transaction in general) to proceed without store personnel.

The present invention may also allow, for example, a customer who has experience with the self-checkout system to customize and increase the speed of the transactions (either manually or automatically). This is accomplished by comparing data collected at the self-checkout and from any alternative databases with a standard customer profile and adjusting system parameters accordingly. Increasing the speed of the transaction may be accomplished by (for example) increasing the speed of the conveyor belts of the self-checkout systems, speeding up the customer user-interface (e.g., the speed at which a graphic display represents transaction information to the customer); skipping or limiting predetermined security measures and changing the user interface, prompts or other system operation.

The present invention may also include ways to slow down a shopping transaction for some customers. Slowing down or changing the transaction for customers who need more time to conduct a self-checkout may be accomplished through at least one or more of the following: slowing down the conveyor belts of the self-checkout systems, slowing down the user-interface (e.g., the speed at which a graphic display represents transaction information to the customer), adding predetermined security measures and/or changing the user interface, prompts or other system operation.

The present invention may allow customers (for preferably customers approved by the retailer), via the user interface, to increase the speed or level of customization of the transaction. Specifically, through a graphic user interface, a screen will instruct the customer to select a transaction speed or different customizable options (for the graphical interface and/or belt speed).

The customer himself, using the GUI, may also be able to choose whether to have promotional discounts and tender types displayed on the monitor as well. The system also provides the ability that, for certain customers, the self-checkout system may adjust system speed or level of customization of the transaction automatically based on shopping history, external database and history profile comparisons.

In addition, the security tolerances and other security programs may be adjusted for experienced customers, allowing for faster processing of experienced customers in one embodiment of the invention. The security measures may be adjusted for those customers with limited risk to process at an accelerated rate. The present invention may also include adjusting system security tolerances and other security programs for those customers with a higher risk profile (e.g., as determined from shopping data captured during previous transactions) to customize to a higher level of scrutiny.

The present invention may also customizes the shopping experience for a particular customer (including, speeding up the transaction) based on any other information that can be associated with the customer (including, demographic data and preferences for example). For example, instead of store specific "produce/no bar code" lookup screen, a customer may instead view a custom created favorites, quick-lookup screen consisting of items that have been purchased by the customer during a recent time period. Accordingly, if the customer recently purchased organic tomatoes and sunflower seeds, then these items may appear on the custom produce, quick-lookup screen. For items not recently purchased, the customer will continue to have the opportunity to select these items using standard screen selection procedures.

The present invention may also provide for customized payment methods. (For example) the system may automatically default to the method of payment that has been used consistently during a recent time period. If the customer wishes to select a different form of payment, the system will revert back to a method of payment selection screen. Thus, if a customer uses a debit card consistently over a time period, the system may automatically prompt the customers to process payment using their debit card and skip the selection screen. If so directed by the customer, the system may even record the form of payment information to eliminate steps in the payment process.

The present invention may also customize system coupon handling. The system may automatically ask for coupons if the customer has used coupons in the recent past, or not ask for coupons if the customer has not used coupons in the recent past.

The present invention may also automatically offers discounts and/or promotional offers based on past or current purchases to the customer. Additionally, the system may automatically displays on screen and printed receipt advertising based on past or current purchases.

The present invention may also provide instructional signaling to store personnel indicating preferential treatment for this customer. For example, a high volume customer, or a customer with a disability (for example), may generate a signal to indicate to the store personnel to provide bagging or carry out assistance.

In another embodiment of the present invention, a customizable self-checkout system includes a self-checkout device for processing items for purchase by a customer, a processor for controlling the operations of the self-checkout device and a memory for receiving customer profile data. The processor adapts the operation of the self-checkout system in accordance with the customer profile data.

In another embodiment of the present invention, a method for customizing a self-checkout system includes receiving customer profile data and adapting the operation of a self-checkout system in accordance with the customer profile data.

In yet another embodiment of the present invention, a system for customizing a self-checkout system includes receiving means for receiving customer profile data and adapting means for adapting the operation of a self-checkout system in accordance with the customer profile data.

In another embodiment of the present invention, a computer readable medium having computer instructions provided thereon for enabling a self-checkout system to perform a method of customizing a shopping transaction, where the method includes receiving customer profile data and adapting the operation of a self-checkout system in accordance with the customer profile data.

In another embodiment of the present invention, a customizable self-checkout system includes a self-checkout device, a processor for controlling the operation of the self-checkout device, a memory for receiving customer profile data, the customer profile data including customer settings for the operation of the self-checkout system and presentation means for presenting the customer settings. The presentation means may includes at least one of a display and a loudspeaker.

These and other objects and advantages of the present invention will become even more clearer with reference to the figures of the present invention, briefly described below, and accompanying detailed description.

DETAILED DESCRIPTION OF THE PREFERRED EMBODIMENTS

Figure 1:
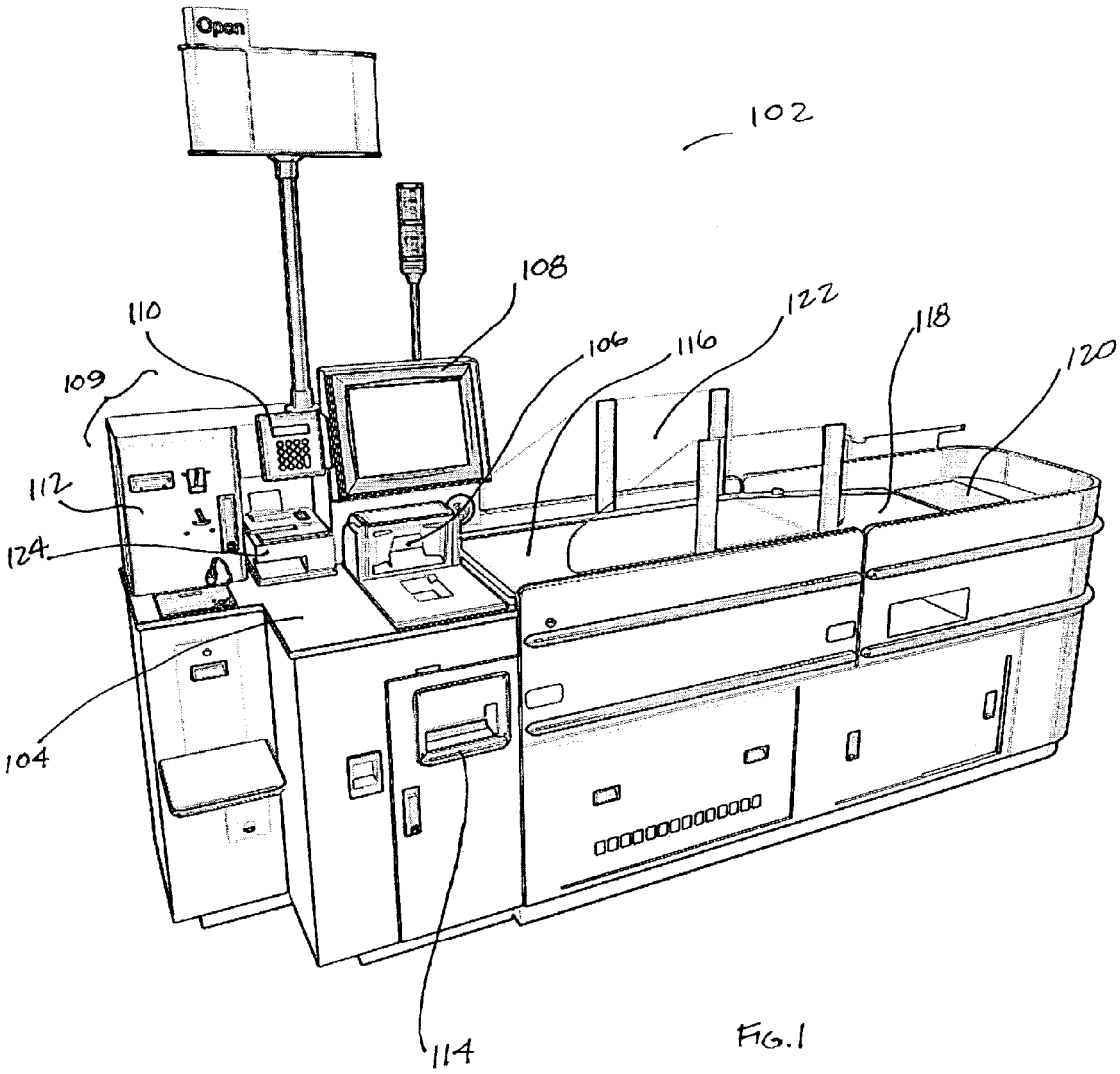
FIG. 1 illustrates a perspective view of a self-checkout device for the embodiments of the present invention.

FIG. 1 is a representative illustration of an embodiment of a self-checkout device 102 for the self-checkout system according to the present invention. Each device includes a counter 104, a universal product code reader 106, a display screen 108 for interactive customer communication, payment mechanism 109, including credit card reader 110, cash acceptor 112 and cash dispenser 114 mechanisms, an entry conveyor 116, an out-feed conveyor 118, a bagging area 120, a tunnel 122, and a receipt unit 124. One of skill in the art will appreciate that the self-checkout device may include, for example, a computer system which controls the overall operation of the self-checkout device. Such a computer system may include, for example, a processor, memory (RAM and/or ROM), data storage devices (CD, DVD, IDE hard drives, floppy drives, etc.), input devices (keyboard, microphone, trackpad, bar-code reader, UPC scanner, magnetic card reader, mouse, RF tag, touchscreen and the like), audio system, and the like. The computer system may be in communication with one or more devices that together form the self-checkout system and/or self-checkout device (see BOSS and POS controllers described below).

One of skill in the art will also appreciate that the present invention may be used with any self-checkout device including a self-checkout lane having, for example, conveyor belts, stationary self-checkout systems, and any other self-checkout systems which generally include a register system and associated security devices.

The above described and illustrated device is preferably used with a security system which uses the known weight of each item to protect against consumer fraud. Using an identification code, preferably a UPC code, the product for purchasing is scanned for purchase, which identifies the product to a UPC database. The database includes associated information about the product including price and physical parameters and dimensions including weight. After the product is scanned, it is placed on a weighing conveyor which weighs the product while transporting it to a security area. If the measured weight is within a predetermined tolerance of the weight listed for the product in the database, the item is transported to a bagging area. If the weight of the product is not within the tolerance for the weight information from the database, the conveyor is reversed and the customer is requested to re-scan the product (see U.S. Pat. No. 4,676,343). Other security methods for preventing consumer fraud in a self-checkout system may be used with the present invention.

Figure 2:
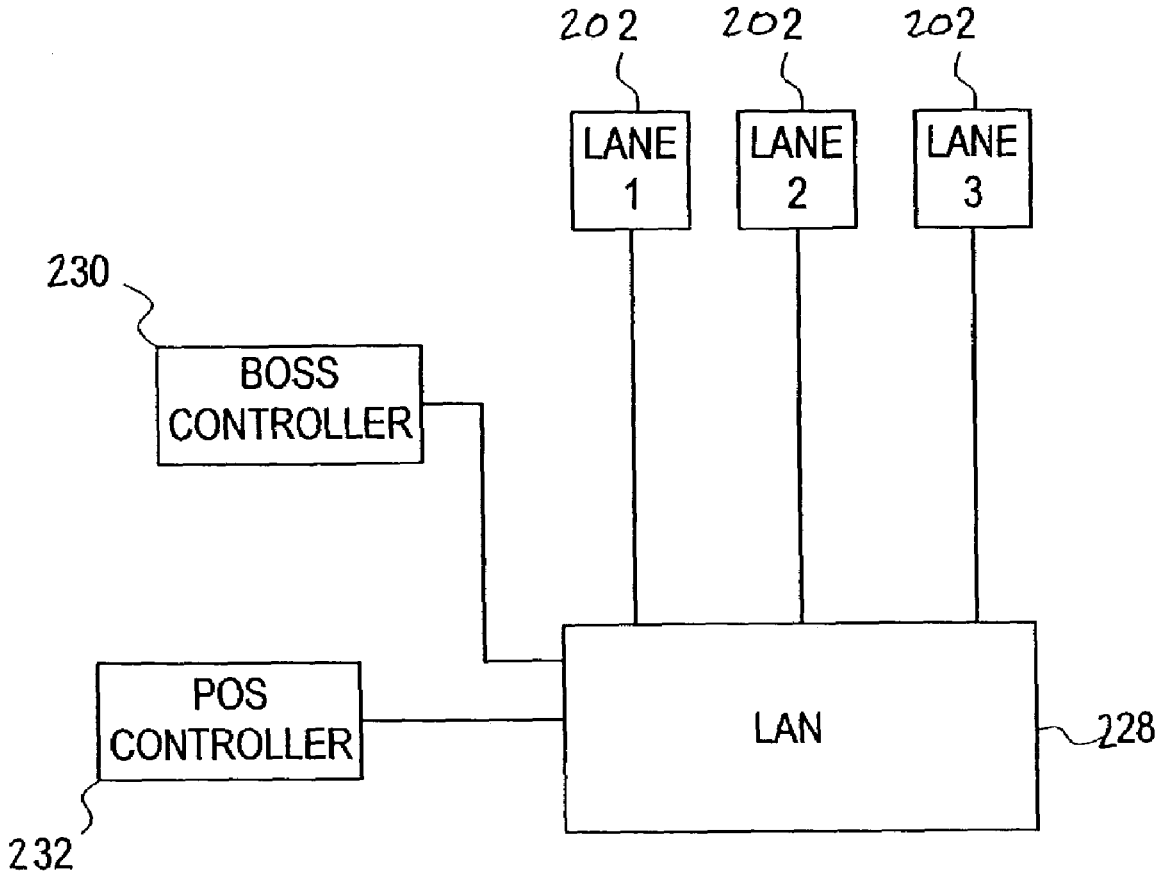
FIG. 2 illustrates a schematic diagram of the overall self-checkout system according to the present invention.

As shown in FIG. 2, in the present invention, a plurality of such devices 202 (and/or associated computer systems associated with the devices) may be linked to a local area network (LAN) 228, which may also be linked with a BOSS controller 230 and a Point-Of-Sale (POS) Controller 232. The BOSS controller manages database information for the devices, i.e., all the information relating to the security aspects of the products: volume, weight, dimensions, and the like, as well as information of customer profiles of customers that have used the self-checkout system (or customers of the retail establishment in general, including customers who may be registered with the retail establishment at another location), and customer transaction data. Such customer profile information may include name and address, to shopping transaction history, payment information, age/sex of the customer, problems that the customer has encountered with the self-checkout system, operational parameters of the self-checkout system and the like.

Supervisory personnel can update this database either at the BOSS controller or they can update a copy of the database at a particular device. Synchronizing software stored in the device and/or BOSS controller and run at predetermined intervals, allows updated database information to be passed from each device to the controller, then from the controller to each device. Thus, changes implemented at one device will ultimately pass to the copy of the database stored at the other devices.

Supervisory personnel may also use the BOSS controller to generate sales and device performance reports, although such reports may be setup to run at a device. One skilled in the art will appreciate, however, that an individual device my be configured to operate as a BOSS controller if necessary, and that the present system does not require a BOSS controller to operate.

The POS controller may manage the point of sale functions of the devices, and also manages the pricing database for products, including type 2 products, or, sold-by-weight products (i.e., meats, salads, and the like). The POS controller is in communication with each device independently, and its operation is not impacted by the presence (or lack of) the BOSS controller.

The controllers at the devices may also include a copy of each of the databases (the pricing database from the point of sale controller, the security database from the BOSS controller and the customer profile database). Thus, the devices may operate independently of those controllers over a period of time. Preferably, however, the self-checkout system according to the present invention is operated with the point-of-sale controller and BOSS controller.

In operation, the concepts of the present invention may be utilized to optimize the self-checkout device's operational parameters to better suit specific customer needs. Preferably, the present invention may use behavioral models which include data for setting the operational parameters to a predetermined setting for a particular type/characteristic of an individual. Preferably, the present invention may include a plurality of behavioral models, each one including different operational parameter settings, and each one being assigned to one or more customers according to information contained in their customer profile. Thus, one behavior model may be designed to be use for experienced customers, and include operational parameter settings which speed up the shopping transaction by increasing conveyor belt speed, display prompting, and the like. Other behavioral models may be designed for slower customers (for example). One of skill in the art will appreciate that a customer may be categorized in one or more behavioral models.

Figure 3:
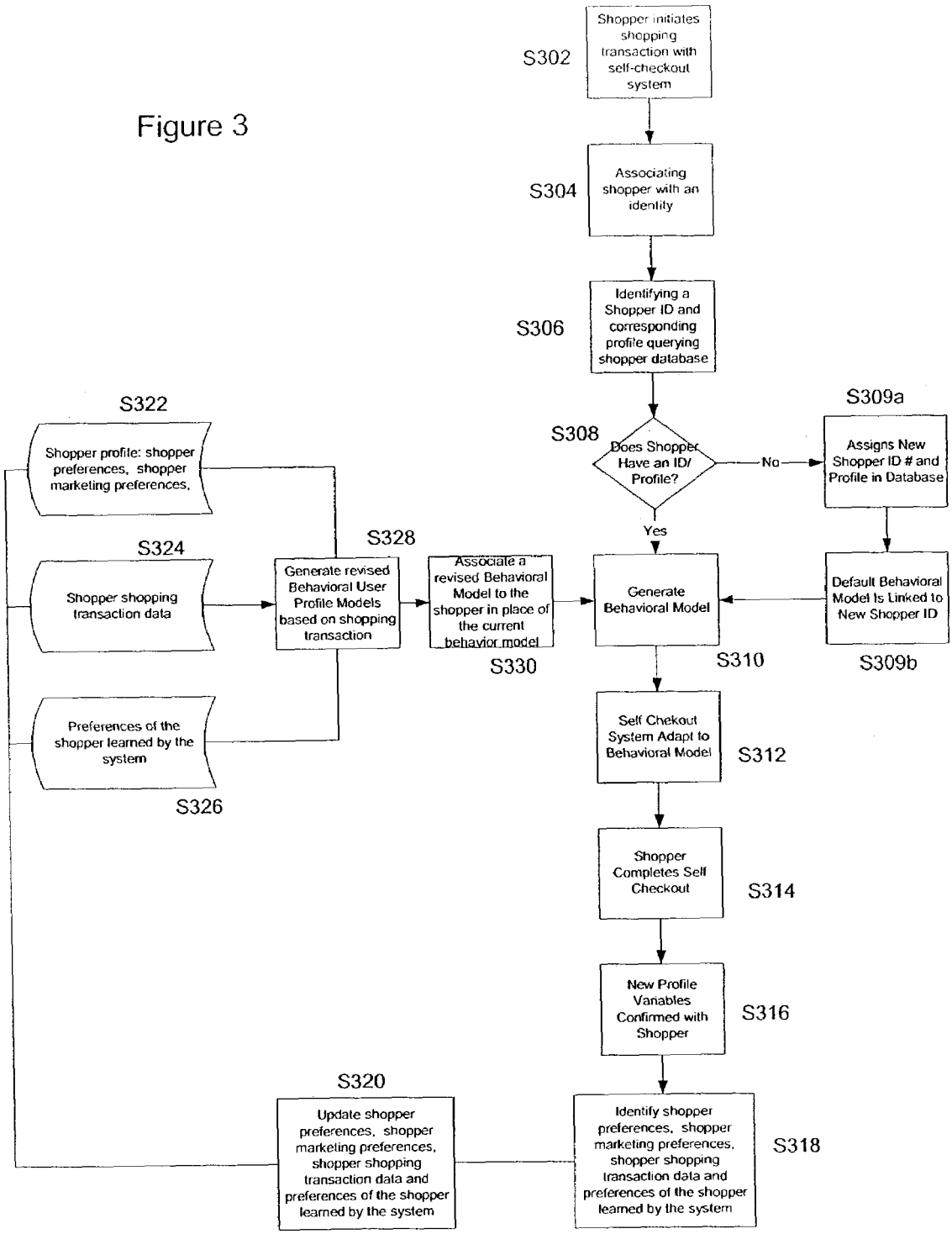
FIG. 3 illustrates a flowchart depicting a process of assigning and updating a behavioral profile a customer at a self-checkout device according to an embodiment of the present invention.

FIG. 3 illustrates an example flowchart for an embodiment of the present invention for customizing a self-service checkout system. Accordingly, a customer initiates a self-checkout using one of the self-checkout devices according to the present invention (S302). The customer identifies himself with a frequent customer card, or other identification source (RF tag, customer identification alphanumeric and/or pin number, credit card, debit card, ebt card, biometrics, and the like) (see Step S304). The self-checkout system queries the customer profile database with the identification information to see if the current customer has used/registered with the system before (S306). If the customer is identified in the system, the behavioral model associated with the customer profile for application to the self-checkout device is generated (S308, S310). If the customer is not identified on the system, the system assigns the customer a new customer identification alphanumeric and profile in the system database (S309*a*, S309*b*). For new customers, a default behavioral model is generated for the shopping transaction (which preferably includes operational profiles which are for new customers).

After the behavioral model has been generated for the shopping transaction, the self-checkout device being used in the transaction operationally adapts to the parameters set out in the generated behavior model. Accordingly, if the customer is a frequent customer, the behavioral model generally includes operational parameter settings for speeding up the shopping transaction.

When the customer has completed the shopping transaction, the system may confirm with the customer one or more new profile variables. This occurs preferably with new customers who are using the system for the first time, but may also be used with existing customers (S118), and preferably occurs during (or in advance of) payment procedures.

During the shopping transaction, the system tracks (preferably) all aspects of the transaction to gather shopping data and transaction data. This gathering of shopping data and transaction data includes (for example) identifying customer preferences (this can be tracked and/or specific input by the customer may be asked for and gathered). These preferences may also include customer marketing preferences for certain goods and related goods, and shopping transaction data in general (e.g., dollar amount of purchase, number of goods purchased, size of goods purchased, and the like). Other preferences may be learned by the system. For example, the system may learn that a particular customer likes particular cuts of beef, certain types of sea food, and the like. The system may also learn about payment preferences, e.g., a particular customer always purchases with a particular form of payment (see steps S114, S116, S118).

Thereafter, the system then updates the customer profile database, a marketing database, and a learned preference database (S122, S124, S126), with the transaction data and shopping data during the recent shopping transaction. Using this stored information, the system may revise the behavioral profiles and adjust them in consideration of the information gathered about the customer and the shopping transaction (S128). After the behavioral models have been revised, the system may revise the particular behavioral model which is assigned to the latest customer (S130). Thus, the next time this customer uses the self-checkout system, the operation of the particular device the customer is using may include different operational parameters according to the revised behavioral model.

Figure 4:
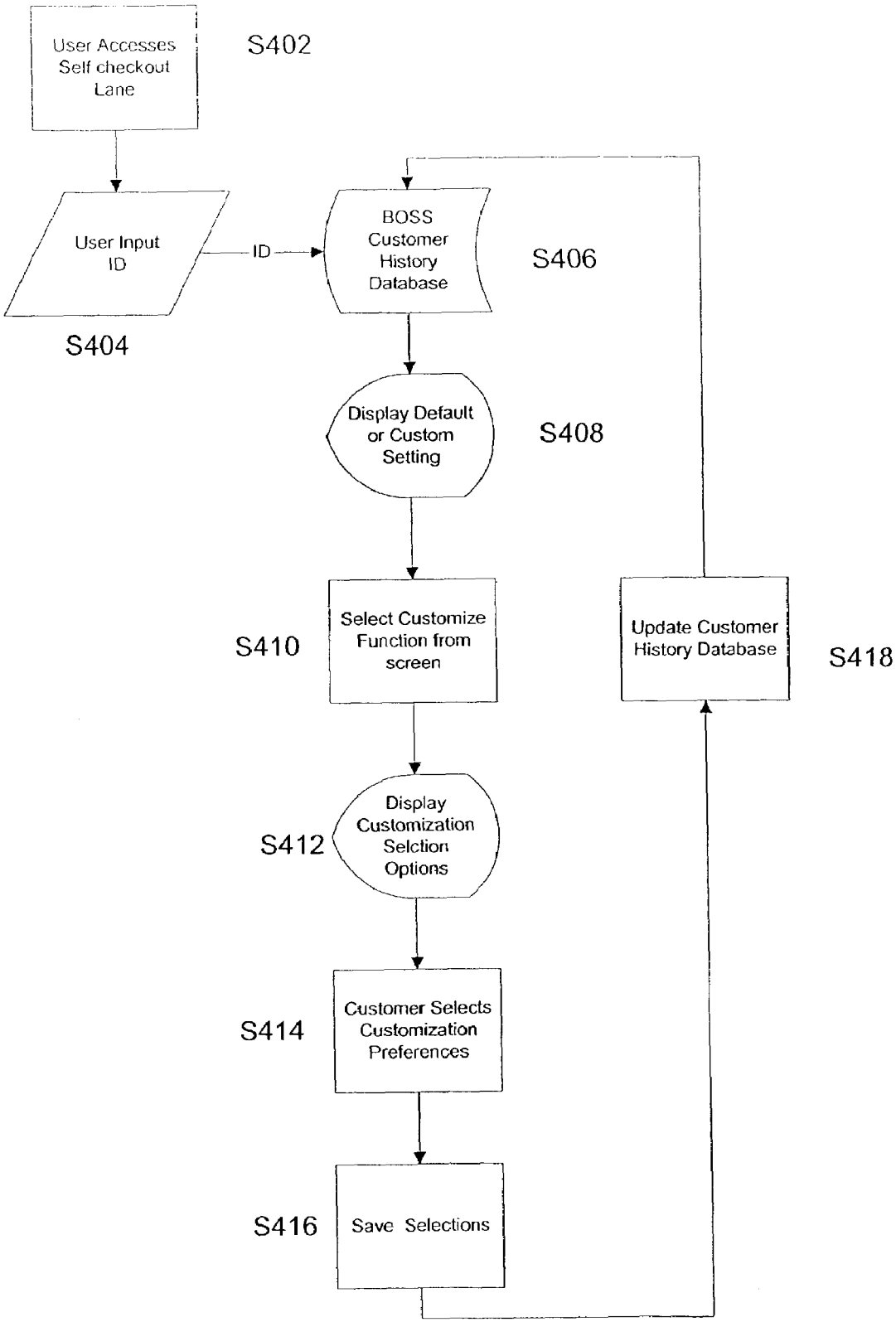
FIG. 4 illustrates a flowchart depicting a process of customizing a shopping transaction at a self-checkout device according to another embodiment of the present invention.

The present invention also includes embodiments directed at using customer input to customize the shopping transaction, and the display settings in particular. Accordingly, as shown in FIG. 4, a customer initiates a self-checkout using one of the self-checkout devices according to the present invention (S402). The customer identifies himself with a frequent customer card, or other identification source (RF tag, customer identification alphanumeric and/or pin number, credit card, debit card, ebt card, biometrics, and the like) (see Step S404). The self-checkout system queries the customer profile database with the identification information to see if the current customer has used/registered with the system before. If the customer is identified in the system, a custom display setting for the customer is used (S408). If the customer is not identified on the system, the system uses a default display setting (S408).

The custom/default displays present one or more customizable functions for the display (S410). For example, the customizable functions may include customization for the speed at which the display functions (e.g., presents information for the shopping transaction, payment, and the like), display views (e.g., split screen, vertical or horizontal, for purchasing product and seeing current transaction data), colors (background, foreground, title bars, etc.), font type/size, and the like.

Upon the selection of a customizable display option, say display views, the display then presents options for the customer to select (vertical split screen, horizontal split screen, no split screen, etc.) (S412, S414). The customer then selects the option, which is then saved and used for the shopping transaction (S416). The customer database may then be updated with the customer selection (S418).

Figure 5:
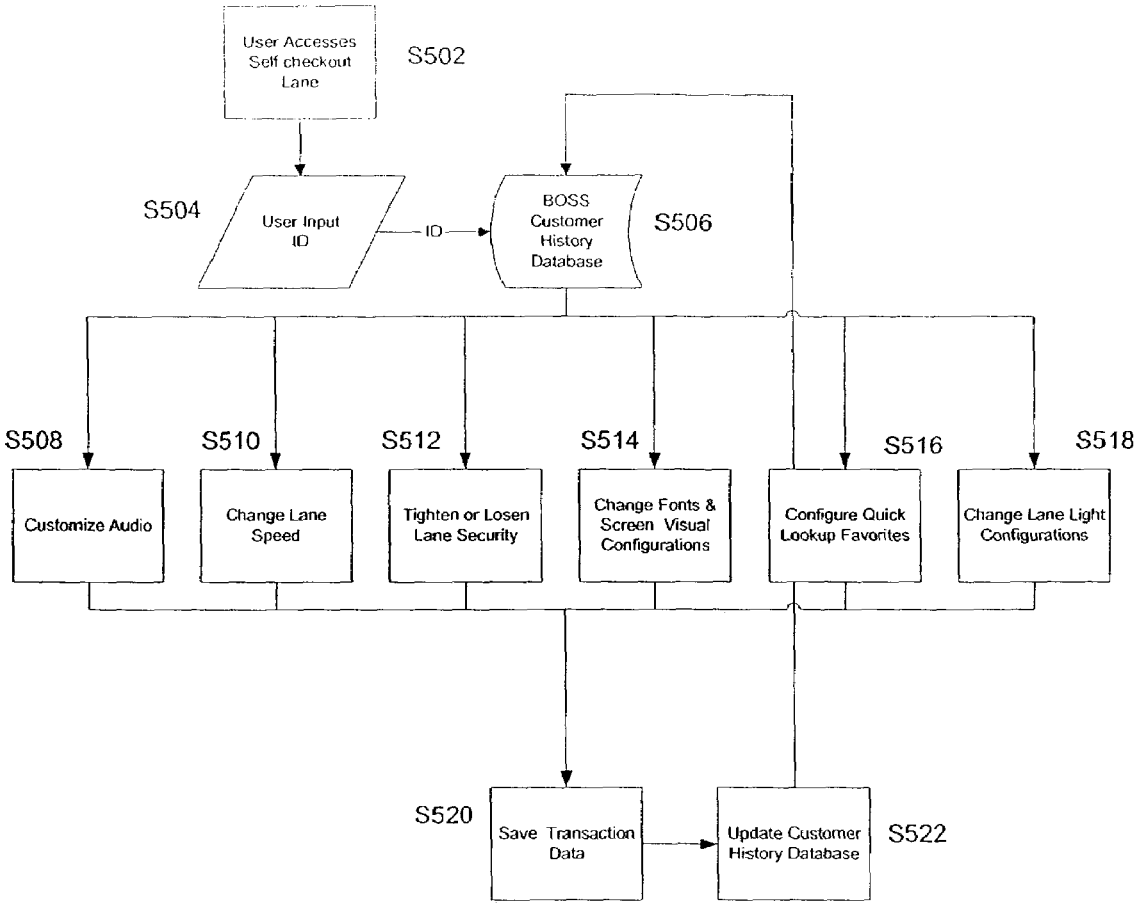
FIG. 5 illustrates a flowchart depicting a process of customized self-checkout device configuration according to another embodiment of the present invention.

Similarly, the self-shopping system may be customized in other respects. As shown in FIG. 5, a customer initiates a self-checkout using one of the self-checkout devices according to the present invention (S502). The customer identifies himself with a frequent customer card, or other identification source (see previous embodiments) (Step S504). The self-checkout system queries the customer profile database with the identification information to see if the current customer has used/registered with the system before (S506). Depending upon whether the customer is identified in the customer database, customizable features of the self-checkout system are displayed for the customer to adjust. Specifically, the customer may change options associated with (for example): customizing audio (S508), customizing device speed (S510), customizing device security (S512), customizing fonts/screen (S514; see above), customizing quick-lookup/favorites (S516), and customizing self-checkout device lighting (S518) (for example). These selections may then be saved in the customer profile database (S520, S522).

The quick-lookup/favorites customization allows a customer to allow the system to collect data (or allows the customer to input specific favorites) about customer preferred, non-bar coded. This allows the customer to skip several, for example, produce lookup screens.

Figure 6:
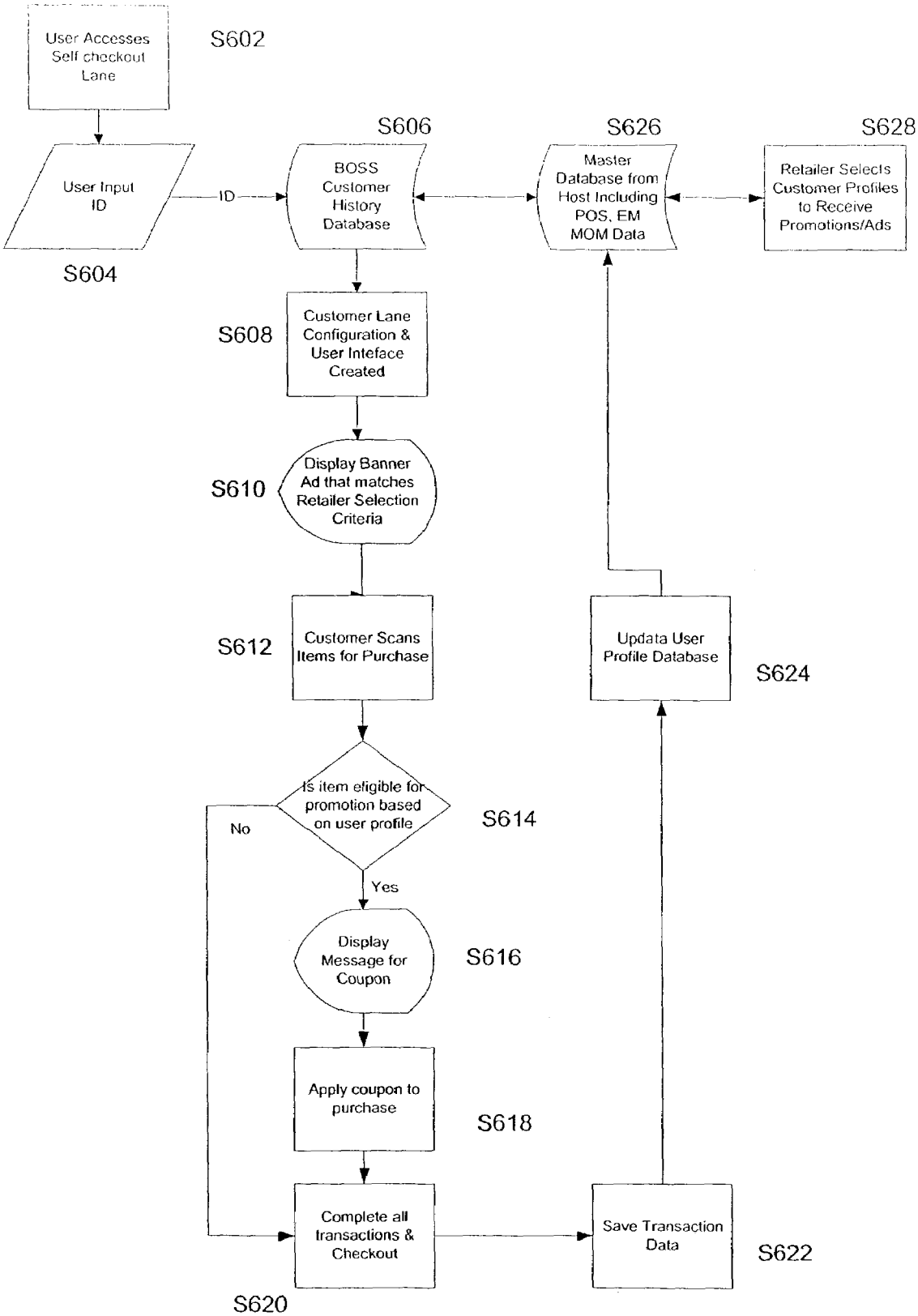
FIG. 6 illustrates a flowchart depicting a process for applying and/or displaying unique marketing programs according to another embodiment of the present invention.

In one of the preferred embodiments of the present invention, customer specific advertising and marketing may be presented to a customer during a shopping transaction. As shown in FIG. 6, as the customer accesses and uses the self-checkout system according to the present invention (S602, S604 and S606), the display at the self-checkout device creates a unique customer user-interface (S608). In particular, the display presents advertisements for the customer (S610). The advertisements are selected based on (preferably) particular criteria/rules selected by the retailer, for matching ads to customers profiles. This criteria may be stored in a marketing database. For example, the retailer may setup the marketing customization of the system such that any customers who buy, for example, soap, and who are woman, may receive advertisements for decorative dishtowels, scented soaps, etc. A customer who purchases motor oil and who is a man may receive ads for car polish, leather cleaner, etc. Accordingly, when the customer scans an item for purchase (S612), the system queries the marketing database with the item and customer profile information against the marketing criteria/rules database/algorithm established by the retailer (S614). Upon the item and customer falling within a rule, corresponding advertisements are displayed. In a preferred embodiment, the advertisement may be a coupon for the particular product which is being purchased (S616). To that end, the customer may choose (or may occur automatically), to apply the coupon to the current transaction (S618). After the transaction has been completed (S620), the transaction/customer data is saved and the customer profile and the marketing database are updated (S622, S624, S626). To that end, such data may also be saved in a centralized retail chain (MOM) database (S626).

In another related embodiment of the present invention, the retailer can setup the self-checkout system such that customers automatically receive promotional advertisements and coupons. This may be done in the same was as was established for the above embodiment, in that certain criteria/rules may be established by the retailers that allows the marketing to be presented to the customer depending upon their profile. Accordingly, men customers who are between the ages of 21 and 30 may receive ads/promotional material regarding cologne, alcoholic beverages, cereals, and the like (S628).

Thus, having presented the present invention in view of the above described embodiment, various alterations, modifications and improvements to the invention and any of the references incorporated by reference are intended to be within the scope and spirit of the invention. The foregoing description is by way of example only and is not intended as limiting. The invention's limit is defined only in the following claims and the equivalents thereto.

What is claimed is:

1. A customizable self-checkout system comprising:

a self-checkout device for processing items for purchase by a customer;

a memory for storing customer profile data;

a processor adapting the operation of the self-checkout system for a particular customer by customizing at least one of a self-checkout processing speed, a display prompting speed, a security level, a lighting scheme, a payment method, coupon acceptance and instructional prompting in accordance with the customer profile data for the particular customer wherein the self-checkout processing speed comprises a speed of a conveyor belt and/or a speed of an instructional presentation.

2. The customizable self-checkout system according to claim 1, further comprising an input device for inputting information into the system.

3. The customizable self-checkout system according to claim 2, wherein the input device is selected from the group consisting of: a magnetic card reader, a scanner, a bar-code reader, a keypad, a touchscreen, a microphone, a joystick, and a computer readable medium.

4. The customizable system according to claim 1, wherein the customer profile data includes at least one of: a profile variable, a customer preference, a learned preference, and/or a shopping transaction history of a customer.

5. The customizable system according to claim 4, wherein the processor adapts the performance of the self-checkout system in accordance with at least one of the profile variable, the customer preference, the learned preference, and/or the shopping transaction history.

6. The customizable self-checkout system according to claim 1, wherein a customer profile includes a behavioral model comprising operational parameters for application to the self-checkout device, and wherein the processor applies the behavioral model to the operation of the self-checkout system.

7. The customizable self-checkout system according to claim 6, wherein the operational parameters include data corresponding to at least one of: a self-checkout processing speed, a display prompting speed, a security level, a lighting scheme, a payment method, coupon acceptance, advertising, instructional prompting, and a customer's favorite products.

8. The customizable self-checkout system according to claim 7, wherein the self-checkout processing speed comprises a speed of a conveyor belt and/or a speed of an instructional presentation.

9. The customizable self-checkout system according to claim 7, wherein a security level comprises at least one of: item pass-around allowance, age-verification system, a number of security resets, and/or the need for personnel to monitor the transaction.

10. The customizable self-checkout system according to claim 6, wherein the processor generates a revised behavioral model based on shopping transaction history.

11. The customizable self-checkout system according to claim 10, wherein the processor associates the revised behavioral model to the customer profile.

12. The customizable self-checkout system according to claim 1, wherein the customer profile data includes data corresponding to at least one of: a self-checkout processing speed, a display prompting speed, a security level, a lighting scheme, a payment method, coupon acceptance, advertising, instructional prompting, and a customer's favorite products.

13. The customizable self-checkout system according to claim 1, wherein a security level comprises at least one of: item pass-around allowance, age-verification system, a number of security resets, and/or the need for personnel to monitor the transaction.

14. The customizable self-checkout system according to claim 1, further comprising a display.

15. The customizable self-checkout system according to claim 1, further comprising an audio system.

16. The customizable self-checkout system according to claim 1, wherein a customer is identified with customer profile data via a customer ID.

17. The customizable self-checkout system according to claim 16, wherein the processor determines whether a customer has been assigned a customer ID, and assigns a new customer ID and/or a default customer profile to the customer.

18. The customizable self-checkout system according to claim 1, further comprising a database for storing customer profile data.

19. The customizable self-checkout system according to claim 1, wherein a new customer profile variable for confirmation by the customer is presented to the customer.

20. The customizable self-checkout system according to claim 1, wherein a marketing preference selection is presented to the customer.

21. The customizable self-checkout system according to claim 1, wherein the processor learns a customer preference.

22. The customizable self-checkout system according to claim 21, wherein the preference includes a marketing preference.

23. A method for customizing a self-checkout system comprising:

receiving customer profile data for a customer;

adapting the operation of a self-checkout system for the customer by customizing at least one of a self-checkout processing speed, a display prompting speed, a security level, a lighting scheme, a payment method, coupon acceptance and instructional prompting in accordance with the customer profile data for that customer wherein the self-checkout processing speed comprises a speed of a conveyor belt and/or a speed of an instructional presentation.

24. The method according to claim 23, wherein the customer profile data includes at least one of: a profile variable, a customer preference, a learned preference, and/or a shopping transaction history of a customer.

25. The method according to claim 24, wherein the operation of the self-checkout system is in accordance with at least one of the profile variable, the customer preference, the learned preference and/or the shopping transaction history.

26. The method according to claim 23, wherein a customer profile includes a behavioral model comprising one or more operational parameters for application to the self-checkout device, and wherein the processor applies the behavioral model to operate the self-checkout system in accordance with one or more of such operational parameters.

27. The method according to claim 26, wherein the operational parameters at least one of: a self-checkout processing speed, a display prompting speed, a security level, a lighting scheme, a payment method, coupon acceptance, advertising, instructional prompting, and a customer's favorite products.

28. The method according to claim 27, wherein the self-checkout processing speed comprises a speed of a conveyor belt, and/or a speed of an instructional presentation.

29. The method according to claim 23, wherein the customer profile data includes data corresponding to at least one of: a self-checkout processing speed, a display prompting speed, a security level, a lighting scheme, a payment method, coupon acceptance, advertising, instructional prompting, and a customer's favorite products.

30. The method according to claim 29, wherein the self-checkout processing speed comprises a speed of a conveyor belt and/or a speed of an instructional presentation.

31. The method according to claim 29, wherein a security level comprises at least one of: item pass-around allowance, age-verification system, a number of security resets, and/or the need for personnel to monitor the transaction.

32. A system for customizing a self-checkout system comprising:

receiving means for receiving customer profile data;

adapting means for adapting the operation of a self-checkout system by customizing for a customer at least one of a self-checkout processing speed, a display prompting speed, a security level, a lighting scheme, a payment method, coupon acceptance and instructional prompting in accordance with the customer profile data for the customer wherein the self-checkout processing speed comprises a speed of a conveyor belt and/or a speed of an instructional presentation.

33. A computer readable medium having computer instructions provided thereon for enabling a self-checkout system to perform a method of customizing a shopping transaction, the method comprising:

receiving customer profile data;

adapting the operation of a self-checkout system by customizing at least one of a self-checkout processing speed, a display prompting speed, a security level, a lighting scheme, a payment method, coupon acceptance and instructional prompting in accordance with the customer profile data wherein the self-checkout processing speed comprises a speed of a conveyor belt and/or a speed of an instructional presentation.

34. A customizable self-checkout system comprising:

a self-checkout device, a processor adapting the operation of the self-checkout system for a customer by customizing at least one of a self-checkout processing speed, a display prompting speed, a security level, a lighting scheme, a payment method, coupon acceptance and instructional prompting in accordance with the customer profile data for the customer wherein the self-checkout processing speed comprises a speed of a conveyor belt and/or a speed of an instructional presentation, a memory for receiving customer profile data for one or more customers, the customer profile data including customized settings for the operation of the self-checkout system for each customer; and presentation means for presenting the customer settings.

35. The customizable system according to claim 34, wherein the presentation means comprises at least one of a display and a loudspeaker.

36. The system according to claim 34, further comprising an input device.

37. The customizable system according to claim 36, wherein the input device is selected from the group consisting of: a magnetic card reader, a scanner, a bar-code reader, a keypad, a touchscreen, a microphone, a joystick, and a computer readable medium.

38. The system according to claim 34, wherein the customized settings comprise at least one of: a self-checkout processing speed, a display prompting speed, a security level, a lighting scheme, a payment method, coupon acceptance, advertising, instructional prompting, and a customer's favorite products.

39. The system according to claim 38, wherein the self-checkout processing speed comprises a speed of a conveyor belt, and/or a speed of an instructional presentation.

40. The system according to claim 39, wherein a security level comprises at least one of: item pass-around allowance, age-verification system, a number of security resets, and/or the need for personnel to monitor the transaction.

41. The system according to claim 36, wherein the customized settings are further customizable by the customer.

* * * * *